US005105635A

United States Patent [19]

Kiuchi et al.

[11] Patent Number: 5,105,635

[45] Date of Patent: Apr. 21, 1992

[54] CONTROL DEVICE FOR WASHING MACHINE

[75] Inventors: Mitsuyuki Kiuchi, Nara; Hisayuki Imahashi, Kawanishi; Sadayuki Tamae, Toyonaka; Shoichi Matsui, Kawanishi; Akihito Ohtani, Suita, all of Japan

[73] Assignee: Matsushita Electric Industrial Co., Ltd., Osaka, Japan

[21] Appl. No.: 617,617

[22] Filed: Nov. 26, 1990

[30] Foreign Application Priority Data

Nov. 29, 1989 [JP] Japan ..... 1-309615

[51] Int. Cl.[5] ..... D06F 33/02

[52] U.S. Cl. ..... 68/12.04; 68/12.02; 68/12.05

[58] Field of Search ..... 68/13 R, 12.01, 12.02, 68/12.04, 12.05

[56] References Cited

U.S. PATENT DOCUMENTS 4,222,250 9/1980 Torita .
4,372,134 2/1983 Matsuo ..... 68/12.02
4,653,294 3/1987 Akinaga .

FOREIGN PATENT DOCUMENTS 0058576 8/1982 European Pat. Off. .
0160000 7/1986 Japan ..... 68/12.02
61-213094 9/1986 Japan .
0004999 2/1987 Japan ..... 68/12.02
2041695 2/1987 Japan ..... 68/12.02

*Primary Examiner*—Philip R. Coe
*Attorney, Agent, or Firm*—Stevens, Davis, Miller & Mosher

[57] ABSTRACT

The control device for a washing machine is provided to have a function of testing the working characteristic of the transmission sensing device for sensing light transmission of water filled while the water supplied in a washing bath is fresh before putting detergent therein or stirring the cloth for rinsing. The control device makes it possible to automatically test the working characteristic of the transmission sensing device and judge if abnormality takes place if the washing or rinsing operation is executed while the washing machine is in operation.

7 Claims, 4 Drawing Sheets

CONTROL DEVICE FOR WASHING MACHINE

BACKGROUND OF THE INVENTION

1. Field of the Invention

The present invention relates to a control device for a washing machine wherein a transmissivity sensing device having a luminous element and light sensing element and serves to sense how foul the washing water is.

2. Description of the Related Art

A normal control device for a washing machine is designed to provide a foul sensing device, in a drain path of the washing machine. Using a transmission sensing device, the foul sensing device serves to sense the degree of light that is transmitted through the water in a washing bath for controlling functions of the washing machine such as washing and rinsing. In such a control device, there has been proposed a method for checking the transmission sensor as disclosed in JP-A-61-213094. This method is designed to sense and display how much an optical axis of a luminous element has moved away from that of a light sensing element or how foul their elements are, based on the sensed light transmission in the manufacturing process. The method thus makes it easy to test the product.

The main object of the method disclosed in JP-A-61-213094 is to check for defective light transmission in the manufacturing process. This method, therefore, needs troublesome techniques for manipulation under the special condition of the domestically-used washing machine.

SUMMARY OF THE INVENTION

It is therefore a first object of the present invention to provide a control device for a washing machine which can check if the transmission sensing device used in the washing machine operates properly for judging if abnormality takes place even when it is used at home.

It is a second object of the invention to provide a control device for a washing machine which serves to carry out necessary functions of the washing machine such as washing and rinsing if abnormality is sensed by the transmission sensing device for supplying a control signal for those functions.

It is a third object of the invention to provide a control device for a washing machine which can control the necessary functions of the washing machine such as washing and rinsing suit to the material to be washed if abnormality is sensed by the transmission sensing device.

It is a fourth object of the invention to provide a control device for a washing machine which can distinguish the cause of the sensed abnormality, that is, that resulting from failure of the transmission sensing device itself from that resulting from failure of any other part.

It is a fifth object of the invention to provide a control device for a washing machine which can positively test the working characteristic of the transmission sensing device using fresh water so as to prevent the condition of the sensing device from being erroneously determined.

In carrying out the first object, according to a first aspect of the invention, the control device includes a transmission sensing device for sensing the degree of light that is transmitted through water in a washing bath, a control unit for controlling washing, rinsing or dehydrating in response to an output signal transmitted by the transmission sensing device, and a memory unit. The control unit serves to test the working characteristic of the transmission sensing device while fresh water is in the washing bath before putting detergent therein or stirring the water for rinsing the material to be washed (hereinafter, referred to as the clothes) and, if abnormality is judged, instruct the memory unit to record the abnormal state.

According to the second aspect of the invention (for the second object), the control device serves to execute washing, rinsing or dehydrating in accordance with predetermined procedures when an abnormality is determined.

According to the third aspect of the invention (for the third object), the control device serves to control washing, rinsing or dehydrating in accordance with the mass of clothes sensed by a cloth mass sensor when abnormality is judged.

According to the fourth aspect of the invention (for fourth object), the control device includes a transmission sensing device having an optical sensor consisting of a luminous element and a light sensing element, a luminous output control unit for controlling the quantity of light emitted by the luminous element, and an output section for picking up an output of the light sensing element. The control unit serves to disable an output of light when it receives a reference value sent from the output section in the working range of the luminous output control unit.

According to the fifth aspect of the invention (for the fourth object), a control device includes the transmission sensing device having an optical sensor consisting of a luminous element and a light sensing element, a luminous output control unit for controlling the quantity of light emitted by the luminous element, and an output section for picking up an output of the light sensing element. The control unit serves to set the output of the luminous output control unit as a predetermined value and determine if abnormality takes place in the transmission sensing device based on the output value of the output section matched to the predetermined value.

For example, depending on the output value of the control section, the kind of abnormality is determined such as short-circuit or open failure of the light sensing element, or too much fouling of the luminous element or a portion on which the luminous element is attached.

According to a sixth aspect of the invention (for the fifth object), the control device includes a level sensor for sensing water level of the washing bath. With the level sensor, the control device can sense that the water level of the washing bath reaches a predetermined water level in order to know when the working characteristic of the transmission sensing device is to be executed.

The control device designed according to the first aspect of the invention serves to test the working characteristic of the transmission sensing device when fresh water is in the washing bath before putting detergent therein or stirring the water for rinsing the cloth. It is thus effective in determining if abnormality takes place when the washing machine is used at home for washing and rinsing, for example.

The control device designed according to the second aspect of the invention can perform the predetermined operations such as washing and rinsing when abnormality is determined in the transmission sensing device for supplying a control signal for controlling the operation of the washing machine such as washing and rinsing. It is thus effective in keeping the operations active even if abnormality is judged.

The control device designed according to the third aspect of the invention can control the operations such as washing and rinsing based on the mass of cloth sensed by a cloth mass sensor if abnormality takes place in the transmission sensing device. It is thus effective in controlling the operation of the washing machine to match to the cloth mass. It results in substantially keeping the performance of the operation of the washing machine such as washing and rinsing, because the performance of the washing and rinsing operations depends on the degree of matching the operation of the washing machine to the mass of cloth to be washed.

The control device designed according to the fourth aspect of the invention can variably control the luminous output of the luminous element with the luminous output control unit and, unless the output of the luminous element reaches the reference value, determines that the luminous output control is disabled, that is, the transmission sensing device is disabled by controlling the output of the luminous element.

The control device designed according to the fifth aspect of the invention serves to set as a predetermined value the output of the luminous output control unit for controlling the output of the luminous element and determine what kind of abnormality takes place based on the value output by the light sensing element when the luminous output rests on the predetermined value. For example, if the luminous output reaches a predetermined value and the output of the light sensing element is lower than a constant value, it is judged that the abnormality is derived from the luminous element or the luminous-element-attached portion being too foul. If the output of the light sensing element is zero, it is judged that the abnormality results from the fact that the light sensing element is open. If the output of the light sensing element has a voltage equal to that supplied to the light sensing element, it is judged the abnormality results from the fact that the light sensing element is short-circuited.

The control device designed according to the sixth aspect of the invention starts to test the working characteristic of the transmission sensing device when the water level reaches a predetermined control level (at which the fresh water in the washing bath is positioned higher than the luminous element and the light sensing element included in the transmission sensing device). When testing the working characteristic of the transmission sensing device, the fresh water is positively laid between the luminous element and the light sensing element. It is thus possible to keep the proper working characteristic, resulting in improving efficiency of the working characteristic test.

DESCRIPTION OF THE PREFERRED EMBODIMENTS

An embodiment of the invention will be described with reference to the drawings.

Figure 2:
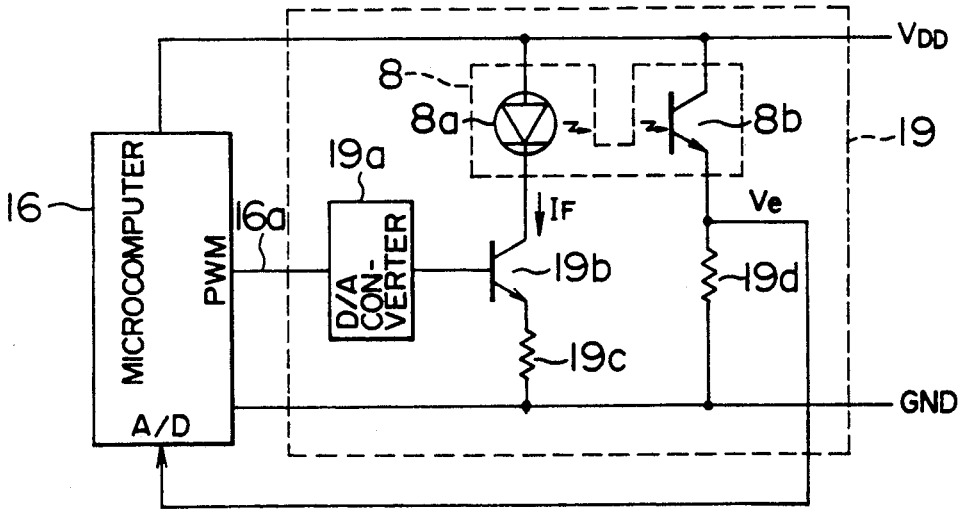
FIG. 2 is a block diagram showing a transmission sensing device included in the control device shown in FIG. 1.

FIG. 2 shows a transmission sensing device included in an embodiment of the invention. 8 denotes an optical sensor having a luminous element 8*a* and a light sensing element 8*b* located in opposition to each other. The optical sensor serves to sense an output signal of the luminous element 8*b* as keeping the luminous output of the luminous element 8*a* constant, resulting in allowing light transmissivity of water in a washing bath to be sensed. The luminous output of the luminous element 8*a* serves to control an output signal (pulse-width control signal, which is termed a PWM signal) of a microcomputer 16. It results in allowing an output signal of the optical sensor 8 to reach a reference value $V_s$ when the water filled in the washing bath is fresh (before putting detergent therein or stirring the water for rinsing the clothes). That is, the PWM signal is converted into a d.c. voltage in a D/A converter circuit so that the resulting voltage can control a base voltage of an NPN transistor 19*b*, the collector of which is connected to the luminous element 8*a*. The transistor 19*b* has an emitter connected to an emitter resistor 19*c* so as to bring about a constant-current effect. The emitter resistor 19*d* of the light-sensing element 8*b* supplies an output signal $V_e$, which is applied to an A/D conversion input terminal of the microcomputer 16. The microcomputer 16 serves to control the luminous element 8*a* so that the output signal $V_e$ is set at the reference value $V_s$ when the water filled in the washing bath is fresh. By sensing a deviation of an output voltage of the optical sensor 8 from the reference value $V_s$, it is possible to sense the degree of light transmission. That is, when the water in the washing bath is fresh, the output voltage $V_s$ of the optical sensor 8 is 100% of transmission, while the ratio $V_e/V_s$ of the output voltage $V_e$ to the output voltage $V_s$ of the optical sensor 8 indicates current transmission of the water filled in the washing bath compared with fresh water.

Figure 3:
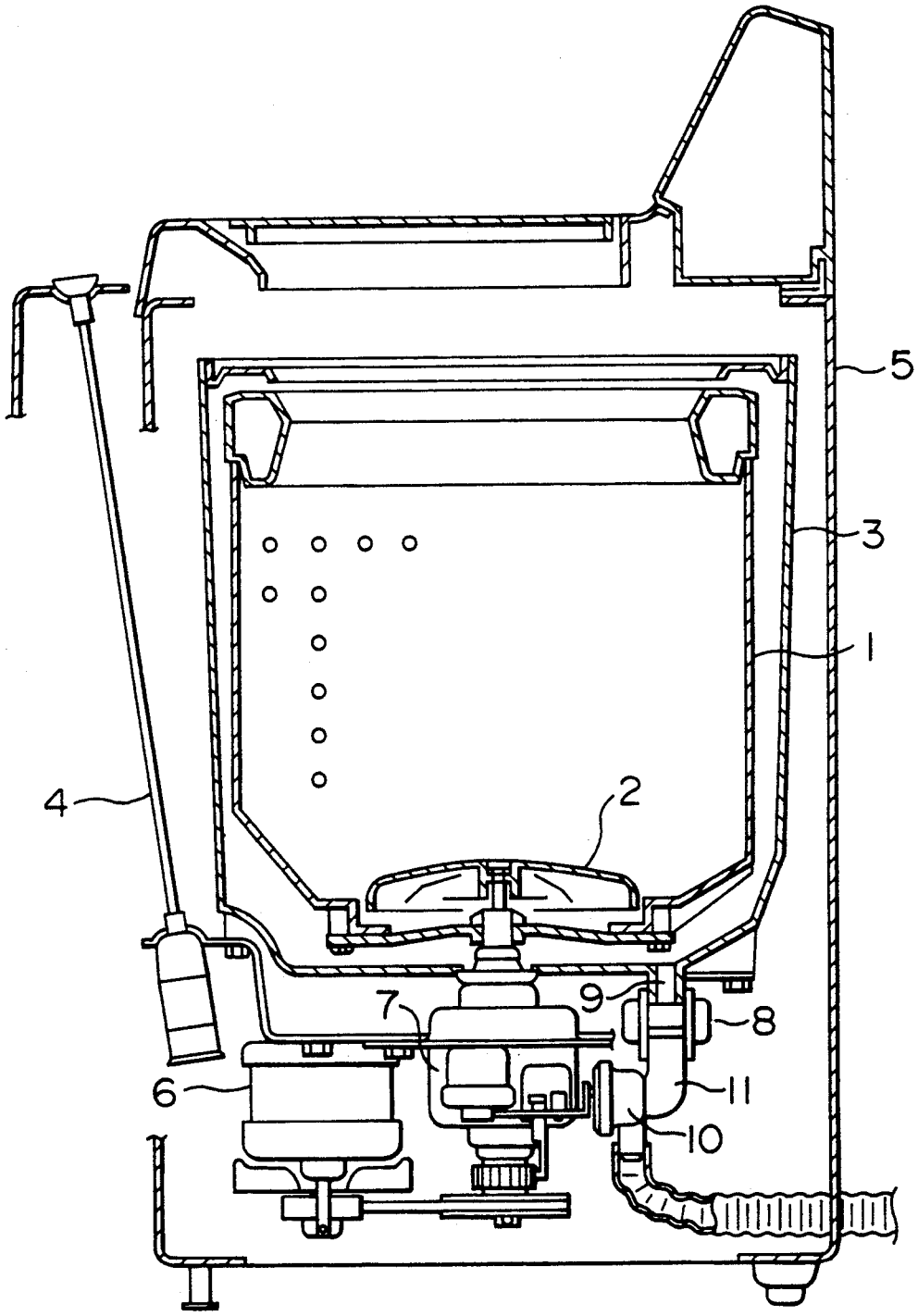
FIG. 3 is a sectional view showing construction of the washing machine according to an embodiment of the invention.

FIG. 3 shows the construction of a washing machine providing the transmission sensing device 19. 1 denotes a washing and dehydrating bath, which provides a stirring vane located on the bottom of the washing and dehydrating bath 1 so that the stirring vane is rotated for washing or rinsing. For dehydrating the cloth, the stirring vane 2 and the washing and dehydrating bath 1 are allowed to be rotated in combination. 3 denotes a washing bath, in which water is filled for washing or dehydrating the cloth. 4 denotes a suspension for suspending the washing bath 3. 5 denotes a box holding the overall components. 6 denotes a motor, which outputs the force of rotation to transmit it to the stirring vane 2 or the washing and dehydrating bath 1 through a decelerating device 7. 9 denotes a drain port provided on the bottom of the washing bath. The drain port 9 is connected to a drain pipe 11 having a drain valve 10. The drain pipe 11 provides the optical sensor 8 which is part of the transmission sensing device 19. For sensing how foul the washed cloth is or how the dehydrating state is, it is necessary to sense light transmission of washing water or rinsing water flowing through the drain pipe connecting the bottom of the washing bath 3 to the drain valve 10.

Figure 1:
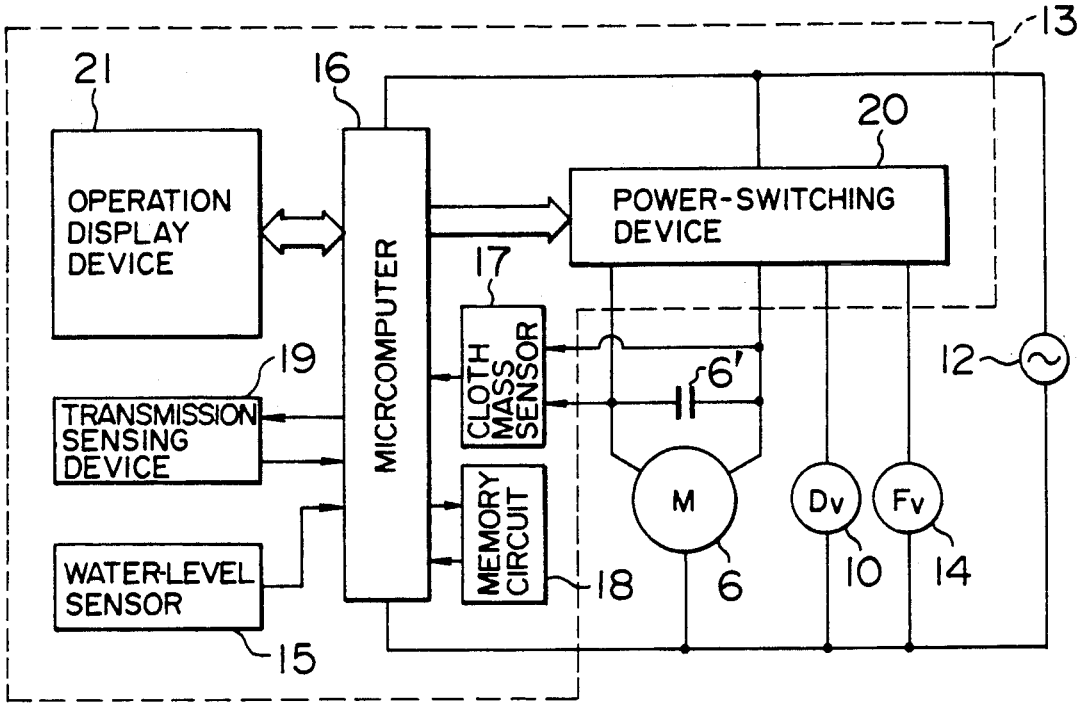
FIG. 1 is a block diagram showing a control device for a washing machine according to an embodiment of the invention.

FIG. 1 is a block diagram showing the control device used in the washing machine. An a.c. power source 12 applies an a.c. power to the control device 13, which controls the motor 6, the drain valve 10, a feeding valve 14, and the like. 6' denotes a phase-advancing capacitor of the motor 6. 15 denotes a water level sensor for sensing a water level of the washing bath 3, 16 is a microcomputer, 17 is a cloth mass sensor for sensing the mass of cloth. During the stirring operation for washing, the motor 6 is alternately activated or deactivated at each given time so that the stirring vane 2 can be rotated or stopped. Based on the voltage applied at the terminal of the capacitor 6' of the motor 6, the sensor 17 serves to sense the number of idle revolutions of the stirring vane 2 when the motor 6 is deactivated during the stirring operation for washing. The sensed number of idle revolutions determines the cloth mass. That is, as the cloth mass becomes smaller, the number of idle revolutions of the stirring vane 2 and the motor 6 becomes larger, thereby increasing damping pulses output by the phase-advancing capacitor 6'. On the other hand, as the cloth mass becomes larger, the phase-advancing capacitor 6' outputs smaller damping pulses when the motor 6 is deactivated. The cloth mass is sensed on this principle. 18 denotes a storage circuit, which serves to store several pieces of data such as the luminous output control data and the reference value of the transmission sensing device 19 and read and write these pieces of data. 20 denotes a power-switching device, which serves to control electric components of the motor 6, the drain valve 10 and the feeding valve 14 in response to the control signal sent from the microcomputer 16. 21 denotes a control display device having various switches and displaying components, on which display a user can indicate or obtain the information.

Figure 4:
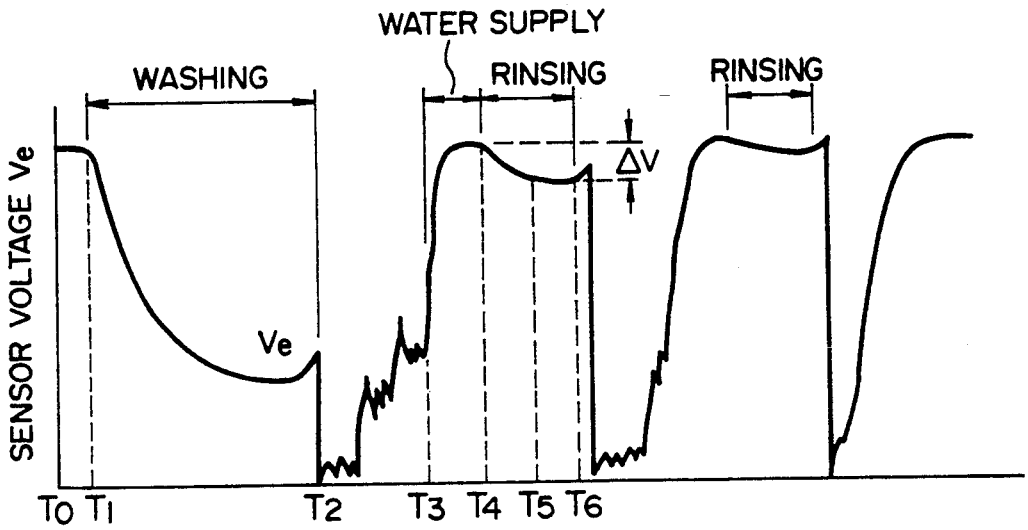
FIG. 4 is a graph showing how an output signal of the transmission sensing device changes in washing, rinsing and dehydrating.

FIG. 4 shows how the voltage $V_e$ of the optical sensor included in the transmission sensing device 19 is changed when washing, rinsing and dehydrating the cloth. The periods of $T_1$ to $T_2$ indicate washing, $T_2$ to $T_3$ indicate drain and middle dehydrating (which serves to remove water containing detergent out of washing cloth by rotating the washing and dehydrating bath 1), $T_3$ to $T_4$ indicate water supply, $T_4$ to $T_6$ indicate rinse-stirring. During the water-supply periods ($T_3$ to $T_4$) for rinsing after middle dehydrating, the luminous output of the transmission sensing device 19 can be controlled so that the sensor output voltage $V_e$ (hereinafter, referred to as sensor voltage) is adjustably controlled to the reference value $V_s$. At this time, the water flowing around the drain pipe 11 of the washing bath 3 is substantially identical to fresh water, thus it is assumed that the water has 100% of light-transmission. The adjustable control of the sensor 19 results in keeping the sensor voltage $V_e$ as a constant value $V_s$ irrespective of how foul the wall of the drain pipe 11 is. Hence, the deviation of the sensor voltage $V_e$ from the constant value $V_s$ matches to the fouling magnitude of the water filled in the washing bath 3. If the inside of the drain pipe 11 is very foul or the luminous output control is disabled, abnormality is determined. During the water supply, the storage circuit 18 serves to store luminous output control data provided when the luminous output is controlled and the sensor voltage $V_e$ is adjusted to the reference value $V_s$, an abnormality flag given when the luminous output control is disabled, or the adjusted sensor voltage $V_e$ (which is substantially identical to $V_s$). The stored data is used for later operations such as rinsing and dehydrating, the next washing, and middle dehydrating process. At $T_5$, that is, after a constant, period has elapsed since the rinsing operation began ($T_4$), the lower transmission is sensed depending on how the sensor-output voltage $V_e$ changes, thereby controlling the later rinsing operation. With the simple drain, only a small quantity of water is allowed to be removed out of the washing cloth. Hence, when washing clothes with larger water absorption, the dehydrated water flows through the drain pipe 11 during the middle dehydrating operation. As shown in FIG. 4, during the dehydrating operation at $T_2$ to $T_3$ periods, the light transmission is made lower.

Figure 5:
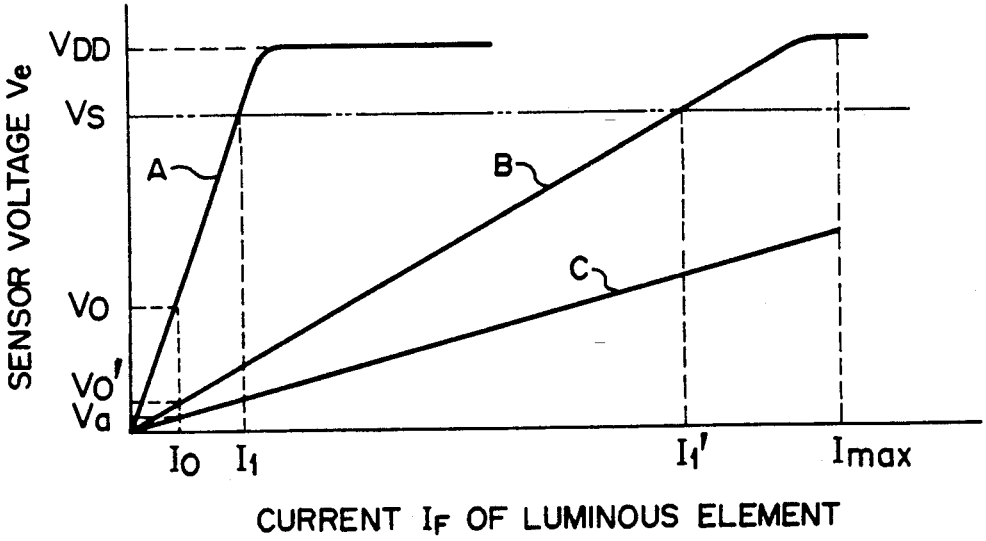
FIG. 5 is a graph showing a control characteristic of the transmission sensing device.

FIG. 5 is a graph showing the control efficiency of the light transmission sensor when the water filled in the washing bath is fresh. That is, the graph indicates the relation between a forward current $I_F$ (see FIG. 2) of the luminous element 8a and an output voltage (sensor-output voltage) $V_e$ of the light sensing element 8a of the optical sensor 8. A denotes a characteristic at an initial stage. Since no fouling is put on the drain pipe 11, the forward current $I_F$ reaches $I_1$, when the sensor-output voltage $V_e$ reaches a reference voltage $V_s$. As the drain pipe 11 becomes more fouled, as shown by a characteristic B, it is necessary to increase the forward current $I_F$ of the luminous element 8a to $I_1'$ for boosting the sensor-output voltage $V_e$ up to the reference value $V_s$. If the drain pipe 11 becomes very foul, as shown by a characteristic C, it is impossible to boost the sensor-output voltage $V_e$ up to the reference voltage $V_s$ even if the forward current $I_F$ of the luminous element 8a is increased to the maximum current $I_{max}$, thereby disabling the transmission sensing device 19 to put the luminous output out of control. It can be decided if the characteristic of the transmission sensing device 19 is normal by the process of reducing the forward current $I_F$ of the luminous element 8a to the current $I_0$ and comparing the sensor voltages $V_e$ matched to the current $I_0$, for example, $V_0$, $V_0'$, $V_a$ with one another. If the light sensing element 8b is short-circuited, the sensor voltage $V_e$ remains $V_{DD}$ even if the forward current $I_F$ is reduced to the small current $I_0$. If the light sensing element 8b is subject to open failure, the sensor voltage $V_e$ is reduced to a zero voltage. This means that failure can be easily determined.

Figure 6:
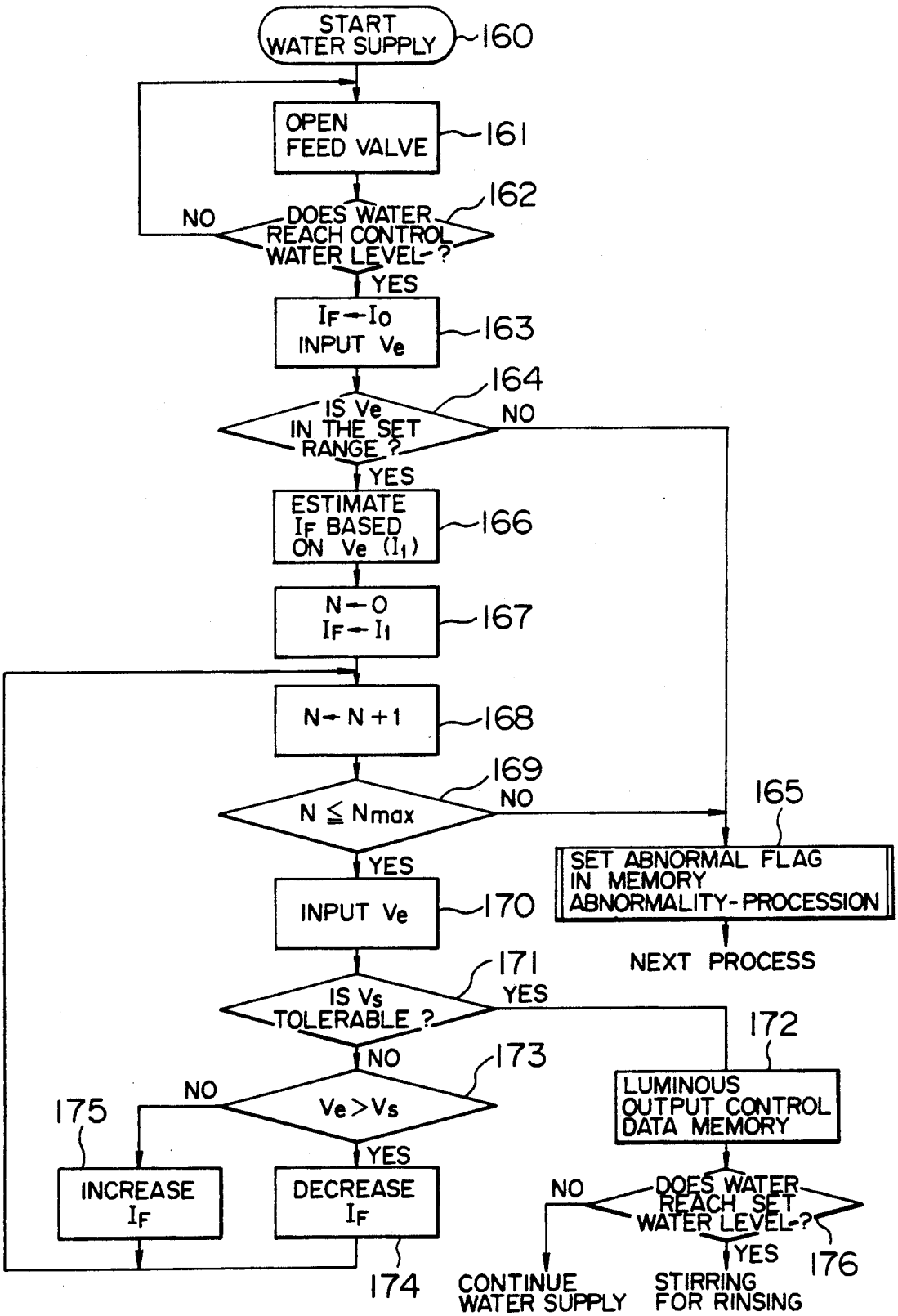
FIG. 6 is a flowchart showing how a luminous output is controlled and abnormality is determined when water is being supplied.

Turning to FIG. 6, the description will be directed to how to test the working characteristic of the transmission sensing device 19 using fresh water. The testing of the working characteristic is implemented when water is supplied to the washing machine before putting detergent therein or stirring the water for rinsing. At a step 160, the water supply is started. Then, at steps 161, 162, it is determined if the water reaches a control level (the water level at which fresh water goes up higher than the optical sensor 8 included in the transmission sensing device 19 in the washing bath) for adjusting sensitivity of the light transmission sensor 19. Proceeding to a step 163, the forward current $I_F$ of the luminous element 8a is reduced to small current $I_0$ for applying the sensor voltage $V_e$ matched to the small current $I_0$ into the microcomputer 16. At a step 164, it is judged if the sensor voltage $V_e$ is within the range ($V_0$ to $V_0'$). If it is not so, at a step 165, an abnormal-processing subroutine starts up. This subroutine can determine the kind of abnormality, such that if the sensor voltage $V_e$ is $V_{DD}$, the light sensing element 8b is short-circuited, if the sensor voltage $V_e$ is zero, the light-receptacle element 8b is subject to open failure, and if the sensor voltage $V_e$ is $V_a$ or lower, the drain pipe 11 is too foul. Further, the subroutine may be designed to store the kind of abnormality.

If, at the step 164, the sensor voltage $V_e$ is within the range, from the value of the sensor voltage $V_e$ (for example, $V_0$), it is presumed that there is forward current $I_F$ of the luminous element 8a (for example, $I_1$) which has the sensor voltage $V_e$ closer to $V_s$. At a step 167, a loop counter N is cleared, so that presumed current $I_1$ is applied to the luminous element 8a. At a step 168, the loop counter N is incremented and then, at a step 169, it is judged if the loop counter N is larger than a maximum value $N_{max}$. The loop consisting of the steps 164 to 169 is intended to reduce the forward current $I_F$ of the luminous element 8a so that the output voltage $V_e$ of the transmission sensing device 19 can reach the reference value $V_s$. If the sensor voltage $V_e$ cannot be adjusted for a constant time, abnormality is judged to have taken place, so that the abnormality-processing subroutine is executed at the step 165. The abnormality may be recorded as luminous output control disable. If the loop counter is within the maximum value, at a step 170, the sensor voltage $V_e$ is applied to the microcomputer 16. Then, at a step 171, it is judged if the sensor voltage $V_e$ is within the predetermined error of the reference value $V_s$. If it is so, the luminous output control is finished. At a step 172, the luminous output control data (for example, a value of the forward current $I_F$ of the luminous element 8a) is stored, and the process goes to a next step. If it is not so, at a step 173, it is judged if the sensor voltage $V_e$ is larger than the reference value $V_s$. Then, the forward current $I_F$ of the luminous element 8a is increased or reduced at a step 174 or 175. The process returns to the step 168 so that the control loop is executed.

The abnormality-processing routine 165 stores an abnormal flag and changes the subsequent rinsing and dehydrating operations or the controlling method of the next washing operation. If an abnormal flag rises relative to the luminous output control disable, the subsequent rinsing and dehydrating operations are carried out in the standard condition. By checking the stored abnormal flag, it is judged if the transmission sensing device 19 is abnormal, if it is abnormal, instead of the abnormal flag, it may be possible to store the luminous light control data as a specific value (for example, 0). If the abnormal flag has risen or the luminous output control data has a specific value, the routine 165 starts to do the abnormal processing.

If the abnormal flag has risen, the abnormal-processing routine 165 is designed to control the subsequent rinsing and dehydrating operations according to the output of the cloth mass sensor 17. For example, if the cloth mass sensor 17 senses that the cloth mass is large, the routine 165 controls the revolution number for rinsing to be more or the rinsing and dehydrating time to be longer. If it is small, the routine 165 controls the revolution number for rinsing to be less or the rising and dehydrating time to be smaller.

The foregoing embodiment has been described mainly relative to the luminous output control in supplying water for rinsing. Yet, it may be possible to implement the luminous output control while the water is supplying before putting detergent in the washing bath. In this case, if abnormality is determined, the series of steps from the subsequent washing to dehydrating operations can be executed on the predetermined working content or the output of the cloth mass sensor 17.

As set forth above, the present invention has the following advantages.

(1) The transmission sensing device is tested for proper operation when water is supplied and before detergent is placed in the washing bath or the water for rinsing is stirred. The testing can be implemented when the washing machine is used at home. Further, every time the washing operation is performed, the transmission sensing device can be precisely tested without adverse effect of detergent, foam or dehydrating vibration.

(2) Since the testing is done when the washing machine is in operation, it is unnecessary to perform a special operation or condition setting.

(3) Since the memory means stores abnormality, it is possible to inform a user of abnormality while the washing machine is in operation or after it finishes the operation, and it is unnecessary to re-test the working characteristic at the next operation again.

(4) If abnormality is recognized, the subsequent washing and rinsing operations are controlled according to the predetermined content. It is thus possible to prevent the washing machine from being stopped without finishing the overall work.

(5) If abnormality is recognized, the subsequent washing and rinsing operations are controlled on the cloth amount of the cloth mass sensor. It is thus possible to keep the proper washing, rinsing and dehydrating performance.

(6) Abnormality is recognized when the luminous output adjusts the light sensitivity of the transmission sensing device based on the output of the light sensing element, that is, a reference value. It is thus unnecessary to provide a special control step for judging abnormality, so that the control program can be made simpler.

(7) Since the type of abnormality is determined, it is possible to quickly and surely determine which portion is to be repaired.

(8) The working characteristic is tested after fresh water reaches a higher position of the washing bath than both the luminous element and the light sensing element and the right water level is sensed by the water-level sensor. Thus, the testing cannot be implemented in any other condition other than the fresh water. It is thus possible to prevent the transmission sensing device from being erroneously tested.

What is claimed is:

1. A control device for a washing machine having a washing tub, said control device comprising:

transmission sensing means for sensing light transmission through a liquid placed in said washing tub and providing an output signal indicating a degree of said light transmission;

control means for controlling washing, rinsing, and dehydrating operations of said washing machine in response to said output signal of said transmission sensing means; and memory means for storing data and communicating with said control means;

said control means comprising estimating means for (i) estimating whether an operational condition of said transmission sensing means is an abnormal condition or a normal condition when fresh water is contained in the washing tube before detergent is placed in the fresh water and before clothes are stirred for rinsing, (ii) when an abnormal condition exists, providing an output signal indicating an abnormal condition of said transmission sensing means and (iii) recording data indicating said abnormal condition in said memory means in response to said output signal from said control means.

2. A control device as in claim 1, wherein said memory means stores data representing predetermined operational procedures of said washing machine; and said control means controls said washing, rinsing, and dehydrating operations according to said predetermined operational procedures after a said output signal indicating an abnormal condition of said transmission sensing means is output by said estimating means.

3. A control device as in claim 1, further comprising a clothes sensor means for sensing an amount of clothes placed in said wash tub; and wherein said control means controls said washing, rinsing, and dehydrating operations according to an amount of clothes sensed by said clothes sensor means.

4. A control device as in claim 1, wherein said transmission sensing means comprises an optical sensor including a luminous means for emitting light having a variable luminous value and a light sensing means for receiving light emitted from said luminous means and providing an output signal indicating an intensity of said light received from said luminous means to said control means; said control means comprises luminous output control means for controlling said luminous value of said light emitted by said luminous element; and said estimating means provides said output signal indicating said abnormal condition of said transmission sensing means when said output signal of said light sensing means has a value smaller than a stored reference value in said memory means.

5. A control device as in claim 1, wherein said transmission sensing means comprises an optical sensor including a luminous means for emitting light having a variable luminous value and a light sensing means for receiving light emitted from said luminous means and providing an output signal indicating an intensity of said light received from said luminous means to said control means; said control means comprises luminous output control means for controlling said luminous value of said light emitted by said luminous element so as to have a predetermined value; and said estimating means provides said output signal indicating said abnormal condition of said transmission sensing means when said output signal of said light sensing means has a value smaller than a stored reference value in said memory means while said luminous output control means controls said luminous value of said light emitted by said luminous element to have said predetermined value.

6. A control device as in claim 5, wherein said washing machine further comprises mounting means for mounting said light sensing means and said luminous means; and said estimating means comprises discriminating means for determining said abnormal condition of said transmission sensing means by discriminating between short circuit failure and open circuit failure of said light sensing means and foulness of said mounting means according to said output of said light sensing means.

7. A control device as in claim 1, further comprising a level sensor means for sensing a liquid level in said washing tub and wherein said estimating means estimates said operational condition of said transmission sensing means when said liquid level is sensed by said level sensor means as having reached a predetermined level.

* * * * *